United States Patent [19]

Lieberoth-Leden et al.

[11] Patent Number: 5,060,613

[45] Date of Patent: Oct. 29, 1991

[54] SYSTEM FOR TRANSFERRING A CONTROL POSITION OF A SET-POINT VALUE TRANSDUCER

[75] Inventors: Bernd Lieberoth-Leden, Leonberg; Güenter Spiegel, Karlsruhe; Karl-Heinrich Preis, Buehlertal; Uwe Schaper, Buehl-Vimbuch; Karlheinz Jansen, Kleve-Griethausen, all of Fed. Rep. of Germany

[73] Assignee: Robert Bosch GmbH, Stuttgart, Fed. Rep. of Germany

[21] Appl. No.: 487,518

[22] Filed: Mar. 2, 1990

[30] Foreign Application Priority Data

Mar. 16, 1989 [DE] Fed. Rep. of Germany ..... 3908596

[51] Int. Cl.[5] ..... F02D 9/02; F02D 11/04

[52] U.S. Cl. ..... 123/399; 123/400

[58] Field of Search ..... 123/361, 399, 400; 74/513

[56] References Cited

U.S. PATENT DOCUMENTS

| | | | |
|---|---|---|---|
| 4,252,089 | 2/1981 | Kramer | 123/365 |
| 4,523,565 | 6/1985 | Omitsu | 123/399 |
| 4,524,740 | 6/1985 | Brockhaus | 123/361 |
| 4,530,326 | 7/1985 | Mann et al. | 123/400 |
| 4,779,592 | 10/1988 | Takeuchi et al. | 123/399 |
| 4,785,691 | 11/1988 | Papenhagen et al. | 123/361 |
| 4,787,353 | 11/1988 | Ishikawa et al. | 123/399 |
| 4,791,902 | 12/1988 | Ishikawa et al. | 123/399 |
| 4,856,476 | 8/1989 | Shirakawa | 123/399 |
| 4,856,477 | 8/1989 | Hanaoka et al. | 123/400 |
| 4,860,708 | 8/1989 | Yamaguchi et al. | 123/400 |
| 4,873,957 | 10/1989 | Ueyama et al. | 123/399 |
| 4,919,097 | 4/1990 | Mitui et al. | 123/399 |
| 4,969,437 | 11/1990 | Kolb | 123/399 |

*Primary Examiner*—Tony M. Argenbright
*Assistant Examiner*—Robert E. Mates
*Attorney, Agent, or Firm*—Edwin E. Greigg; Ronald E. Greigg

[57] ABSTRACT

A system for transferring a control position of a set-point value transducer between the gas pedal and the throttle valve. The system includes an electromechanical device which can adjust a throttle valve out of its position of reponse in opposite directions. This is attained by an intermediate element, which is capable of coming to rest on a repose-position stop. The system is particularly well suited to motor vehicles having traction and/or cruise control.

26 Claims, 4 Drawing Sheets

SYSTEM FOR TRANSFERRING A CONTROL POSITION OF A SET-POINT VALUE TRANSDUCER

BACKGROUND OF THE INVENTION

The invention is based on a system for transferring a control position of a set-point transducer to a control position of a control element that determines an output of a drive machine, as defined hereinafter.

In known systems in a machine, particularly in a vehicle, a control position of a set-point transducer should be transferred to a control position of a control element that determines an output of the driving machine by electromechanical transfer means. The electromechanical transfer means make it possible to vary the transfer. In a vehicle, the variation may for instance become necessary in order to avoid slip, or loss of traction, between the wheels driven by the driving machine and a road surface, or to keep a vehicle speed to a certain value regardless of the control position of the set-point transducer.

If the machine is a vehicle having an Otto engine as the driving machine, then the set-point transducer may for instance be connected via a Bowden cable to a gas pedal, and the control element may be connected with a throttle valve for instance, and the control position of the control element can determine an opening angle of the throttle valve.

The system furthermore includes mechanical transfer means by which the control element can be coupled to the set-point transducer, but the control element is decoupled from the set-point transducer whenever the control position of the control element corresponds to the control position of the set-point transducer. If for any reason the transfer of the control position of the set-point transducer to the control position of the control element by the electromechanical transfer means should fail, then the transfer takes place by means of the mechanical transfer means.

In a known system of this type, signals originating in the set-point transducer are transferred to an electric governor, which in turn affects the control position of a final control element that is connected to a positioning system. Between the set-point transducer and the adjusting system there is also a mechanical transfer element having a compensation element with built-in play, so that the transfer element is decoupled from the set-point transducer and/or from the final control element and/or from the adjusting system whenever the control position of the adjusting system is equivalent to the control position of the set-point transducer.

If the set-point transducer is not actuated, the control position of the adjusting system is moved by a restoring spring to a terminal position corresponding to an idling position. From the terminal position, the control position of the adjusting system can be actuated in only one adjustment direction, which represents a considerable restriction in the possibilities offered by the known system.

The compensation element of the transfer element includes a compression spring. In normal operation this compression spring is intrinsically unnecessary, unless one of the electric transfer means has failed and the adjusting system is to be coupled to the set-point transducer via the mechanical transfer element. For instance, if the compression spring has failed because of a break before this possible instance occurs, then that is not noticed until the adjusting system is to be coupled to the set-point transducer via the mechanical transfer element, but that coupling cannot be done because of the broken compression spring. This is a safety risk.

OBJECT AND SUMMARY OF THE INVENTION

The system according to the invention has an advantage over the prior art of enabling adjustment of the control element from a position of repose in two adjustment directions. This is accomplished by an intermediate element and by a spring that restores a stop position of the intermediate element counter to a stop position of the control element.

By means of a restoring force of a spring exerted upon the intermediate element, the intermediate element is advantageously restorable to a precisely definable position of repose. If the position of respose is defined by an adjustable repose position stop, then the repose position of the intermediate element is advantageously adjustable as needed.

Since at least in the position of repose of the control element the coupling force of the control element is actuated counter to the intermediate element, if the position of respose of the intermediate element is defined then the position of repose of the control element can be exactly defined as well, which is advantageous. A particularly advantageous feature is that the control element is actuatable out of the position of respose in two adjustment directions.

By means of a contact, it can be detected whether the control position of the intermediate element deviates from the control position of the set-point transducer by more than a definable shifting distance. This may advantageously prevent the situation in which for instance the control element is moved too far in a direction that increases the power of the driving machine, although according to the control position of the set-point transducer a lower power of the driving machine is actually desired. This is advantageous in terms of safety, because undesirably high vehicle speeds, for instance, are precluded in this way.

The clutch between the servomotor and the control element advantageously makes it possible for the control element to be disconnected from the servomotor, for instance if the control position of the control element undesirably deviates excessively from the control position of the set-point transducer. It is also advantageously possible, for instance in the event of failure of the servomotor, to actuate the control element without having to turn over the servomotor as well.

Another advantage is that by means of deflecting the force, the coupling force and the restoring force can both be generated by the same spring, so that one of the springs in the system can be dispensed with.

The invention will be better understood and further objects and advantages thereof will become more apparent from the ensuing detailed description of preferred embodiments taken in conjunction with the drawings.

DESCRIPTION OF THE PREFERRED EMBODIMENTS

The structure and mode of operation of a system embodied according to the invention in a machine, particularly a vehicle, for transferring a control position of a set-point transducer to a control position of a control element that determines an output of a driving machine will now be explained with reference to two exemplary embodiments with three sub-variants and with the aid of FIGS. 1-5.

The system according to the invention can be used in any machine in which the output of the driving machine is to be controlled in any way. The machine may either be mounted in stationary fashion or may for instance be a self-propelled machine, or in other words a vehicle. Although not solely limited to this, for the sake of simplicity, the description of the exemplary embodiments will be provided on the assumption that the system according to the invention is built into a motor vehicle having an Otto engine.

Figure 1:
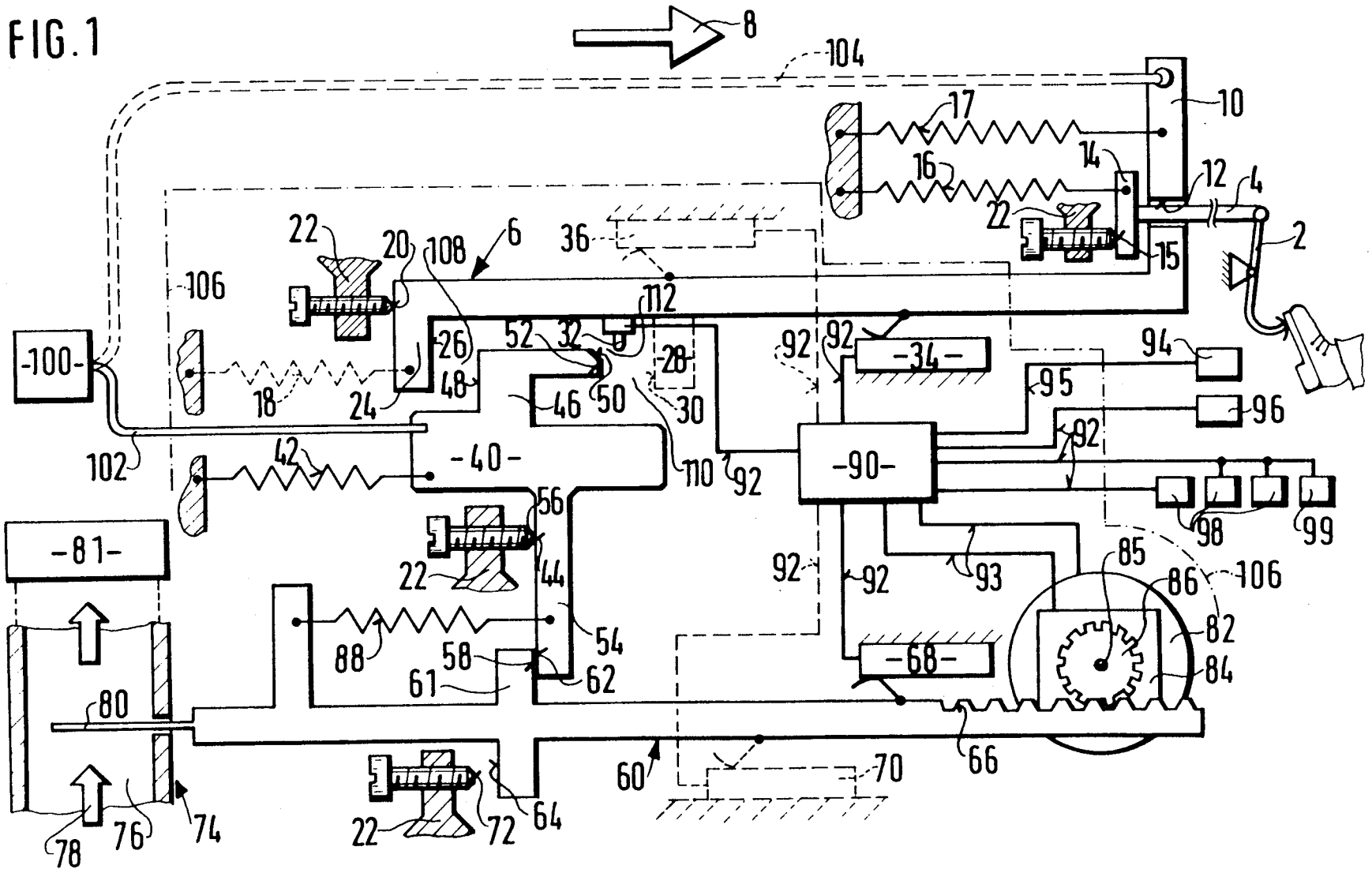
FIG. 1 shows a first exemplary embodiment of a system according to the invention.

FIG. 1 shows the first exemplary embodiment.

In FIG. 1, a foot-actuated operating element is shown at reference numeral 2. In the vehicle having the Otto engine as the driving machine the operating element 2 is a gas pedal, for instance. The operating element 2 can act upon a set-point transducer 6 via a transfer element 4, which may comprise one or more parts and may for instance be a cable, a Bowden cable, a connecting rod assembly, and the like. In the drawing, the adjusting direction of the set-point transducer 6 is parallel to the direction of an arrow 8; that is, it extends in the direction of the arrow and contrary thereto. A lifter 10 is formed on the set-point transducer 6 transversely to the adjustment direction. A through opening 12 is provided in the lifter 10. The transfer element 4 extends through the through opening 12. An enlarged portion 14 of the transfer element 4 is provided on an end remote from the operating element 2. The enlarged portion 14 is shaped such that it can not fit through the through opening 12 of the set-point transducer 6.

A restoring spring 16 acts upon the transfer element 4 counter to the direction of the arrow 8 and has a tendency to actuate the enlarged portion 14 of the transfer element 4 counter to a repose-position stop 15. Another restoring spring 17 acts upon the cam 10 of the set-point transducer 6 counter to the direction of the arrow 8. As needed, an additional restoring spring 18, shown in dashed lines, may also be provided, and likewise acts upon the set-point transducer 6 counter to the direction of the arrow 8. All three restoring springs 16, 17, 18 are not necessary; in principle, one of the restoring springs 16, 17 or 18 suffices. In addition to or instead of the repose-position stop 15, a repose-position stop 20 is provided. The repose-position stops 15, 20 may for instance be face ends of screws each screwed into one part of a wall 22. The screws for the repose-position stops 15, 20 may be adjusted in the adjustment direction, or in other words parallel to the arrow 8. The restoring springs 17, 18 actuate the set-point transducer 6 counter to the repose-position stop 20.

A further lifter 24 having a stop 26 is formed transversely to the adjusting direction of the set-point transducer 6. Moreover, as needed, a slaving element 28, shown in dashed lines on the set-point transducer 6 transversely to its adjusting direction, is formed, protruding outward and having a stop 30. An electrical contact 32 of a normally closed switch is also located on the set-point transducer 6.

The system further includes a travel measuring system 34, with which the control position of the set-point transducer 6 can be detected. As needed, a further travel measuring instrument 36 is also present, with which the control position of the set-point transducer 6 can likewise be detected.

The system further includes an intermediate element 40. The adjusting direction of the intermediate element 40 likewise extends parallel to the direction of the arrow 8. A further repose-position stop 44 is provided in one part of the wall 22. In this exemplary embodiment, the repose-position stop 44 includes a screw, so that this stop 44 can be adjusted as needed parallel to the direction of the arrow 8. A protrusion 46 having a stop face 48, a contact face 50 and as needed a further stop face 52 is provided on the intermediate element 40 relative to the electrical contact 32. The intermediate element 40 further includes a lifter 54 having a stop location 56 and a further stop location 58. A restoring force of a spring 42 acts upon the intermediate element 40 counter to the direction of the arrow 8. The restoring force of spring 42 actuates the intermediate element 40 having the stop location 56 counter to the repose-position stop 44. The stops 26, 30 on the set-point transducer 6 and the stop faces 48, 52 of the intermediate element 40 are provided such that depending on the control position of the set-point transducer 6 and intermediate element 40, the stop 26 can come to rest on the stop face 48 or the stop 30 can come to rest on the stop face 52.

A further essential element of the system is a control element 60. The control element 60 is likewise adjustable parallel to the direction of the arrow 8. The control element 60 includes a step 61 having a stop face 62, a stop face 64 and a gear teeth profile 66. The stop location 58 of the intermediate element 40 and the stop face 62 of the control element 60 are provided such that depending on the control position of the intermediate element 40 and control element 60, the stop face 62 can come to rest on the stop location 58.

By means of a travel measuring instrument 68, the control position of the control element 60 can be detected. As needed, the control position of the control element 60 can also be detected via a further travel measuring instrument 70. Upon adjustment of the control element 60 counter to the direction of the arrow 8, the stop face 64 of the control element 60, in a terminal position, can come to rest on an end stop 72. The end stop 72 is adjustable parallel to the arrow 8 by means of a screw disposed in a portion of the wall 22.

Any arbitrary type of control device 74 may be connected to the control element 60. In the exemplary embodiment, the control device 74 for instance includes an intake tube portion 76 and a throttle valve 80 displaceably disposed transversely to the flow direction of a flow, such as air, symbolically represented by arrows 78. Downstream, the flow reaches the driving machine 81. With the throttle valve 80, the throttle cross section in the intake tube portion 76 can be varied. In the exemplary embodiment shown, an adjustment of the control element 60 and hence of the throttle valve 80 in the direction of the arrow 8 means an adjustment in the direction of greater output of the driving machine 81. An adjustment of the control element 60 in the opposite direction means a decrease in the output.

The system according to the invention further includes a servomotor 82, a clutch 84 having an outgoing shaft 85, and a drive wheel 86 connected to the outgoing shaft 85. Depending on the shifting status of the clutch 84, the drive wheel 86 is either coupled to the servomotor 82, or not so connected.

A coupling force of a spring 88 acts in one direction on the control element 60 and in the other on the intermediate element 40. The coupling force acts on the control element 60 in the direction of the arrow 8 and on the intermediate element 40 in the opposite direction of the arrow 8, so that the coupling force of the spring 88 tends to actuate the stop location 58 of the intermediate element 40 toward the stop face 62 of the control element 60.

The system according to the invention is also provided with an electronic control unit 90. The contact 32 and the travel measuring instruments 34, 36, 68, 70 are connected electrically via cables 92 to the control unit 90. The servomotor 82 and the clutch 84 are electrically coupled via cables 93 to the electronic control unit 90.

The electronic control unit 90 is also connected via an electrical energy supply cable 95 to an electrical energy supply unit 94. The electronic control unit 90 may also be connected to a transducer 96 and to sensors 98 via further electrical cables 92. If the system according to the invention is installed in a vehicle, then the electrical energy supply unit 94 is typically a battery. The transducer 96 may for instance be a speedometer, with which a driver of the vehicle can input his desired set-point driving speed, and the sensors 98 may for instance be temperature sensors to detect a coolant temperature and/or sensors for detecting the rotational speed of the vehicle wheels or of the driving machine 81 and/or sensors that can detect an actuation of a brake pedal, for instance. The electrical control unit 90 may also be connected to a further electrical control unit 99, for instance for controlling a brake system and/or one for controlling ignition of the driving machine 81.

An actuatable element is identified by reference numeral 100. The actuatable element 100 is either connected via a Bowden cable 102 to the intermediate element 40 or via a Bowden cable 104, shown in dashed lines, to the set-point transducer 6. Via the Bowden cable 102, the control position of the intermediate element 40 can be transferred to the actuatable element 100, or via the Bowden cable 104, the control position of the set-point transducer 6 can be transferred to the actuatable element 100. The actuatable element 100 may for instance be an automatic transmission, a so-called kick-down switch, a pivot lever of an adjustable pump, and so forth. Instead of the Bowden cable 102 or 104, a cable, connecting rod linkage or any other kind of actuating means 102, 104 may be used.

At least some individual parts of the system according to the invention are enclosed by a housing 106 and thus protected against environmental factors. The housing 106 is partly represented by dot-dash lines in this drawing.

Upon actuation of the transfer element 4 by the operating element 2 in the direction of the arrow 8 counter to the spring 16, the enlarged portion 14 comes to rest on the lifter 10 of the set-point transducer 6. Thus the set-point transducer 6 can be actuated by the operating element 2 in the direction of the arrow 8, counter to the restoring springs 17, 18. When the operating element 2 is not actuated, the transfer element 4 is actuated by the restoring spring 16, and the set-point transducer 6 is actuated by the restoring springs 17 and 18 counter to the direction of the arrow 8, until the set-point transducer 6 comes to rest on the repose-position stop 20 and the enlarged portion 14 of transfer element 4 comes to rest on the repose-position stop 15.

The control position of the set-point transducer 6 can be detected by the travel measuring instruments 34, 36. Measurement signals obtained from these instruments 34, 36 are delivered via the electrical cables 92 to the electrical control unit 90. With the travel measuring instruments 68, 70, the control position of the control element 60 can be detected. Depending on the control position of the control element 60, the travel measuring instruments 68 and 70 forward measuring signals to the control unit 90 via the electrical cables 92. Further electrical signals originating in the transducer 96, the sensors 98 and the further control unit 99 are likewise sent to the electronic control unit 90 via the electrical cables 92. From the measurement signals of the travel measuring instruments 34, 36 and from the further signals, the electronic control unit 90 ascertains a set-point value for the control element 60, and depending on what control position the travel measuring instruments 68, 70 find for the control element 60, the electronic control unit 90 triggers the servomotor 82. By means of the servomotor 82, and via the clutch 84 and drive wheel 86, the control element 60 is moved to the desired control position.

The system according to the invention substantially comprises mechanical transfer means and electromechanical transfer means. The mechanical transfer means include among other elements the transfer element 4, the set-point transducer 6, the intermediate element 40, the springs 42, 88 and the control element 60. The electromechanical transfer means include among others the travel measuring instruments 34, 36, the travel measuring instruments 68, 70, the electronic control unit 90, the servomotor 82 and the clutch 84.

In the system according to the invention, a distinction can essentially be made among five operating states. First operating state: emergency operation with operating element 2 not actuated. The clutch 84 is released; that is, no transfer of force between the servomotor 82 and the control element 60 takes place, and as a result the electromechanical transfer means are not in service. The set-point transducer 6, the intermediate element 40 and the control element 60 are in their position of repose. Second operating state: as in the first operating state, the operating element 2 is not actuated. In the second operating state the clutch 84 is shifted such that it permits a transfer of force from the servomotor 82 to the control element 60; that is, an adjustment of the control element 60 by means of the electromechanical transfer means is possible. Third operating state: regular operation with operating element 4 to be actuated. Here, a control position of the set-point transducer 6 is transferred to the control element 60 by means of the electromechanical transfer means. The clutch 84 is engaged. Fourth operating state: emergency operation with actuated operating element 2. In emergency operation, a control position of the set-point transducer 6 is transferred to the control element 60 by means of the mechanical transfer means. The clutch 84 is disengaged. Fifth operating state: cruise control state, i.e. an operating state with regulated vehicle speed. The operating element 2 is not actuated. A desired set-point vehicle speed is specified by the transducer 96.

In the first operating state, that is, when the operating element 2 is not actuated, the transfer element 4 rests with the enlarged portion 14 on the repose-position stop 15, and the set-point transducer 6 rests on the repose-position stop 20. In this operating state, the clutch 84 is released, for instance as a result of some electrical defect of an arbitrary kind. The stop location 56 of the intermediate element 40 rests on the repose-position stop 44, because of the restoring force of the spring 42. If the set-point transducer and the intermediate element 40 are in their position of repose described here, then there is a spacing 108 present between the stop 26 of the set-point transducer 6 and the stop 48, and there is a spacing 110 between the stop face 52 and the stop 30, if in fact there is a stop 30 of the set-point transducer 6. Between the contact face 50 and the electrical contact 32, there is a shifting distance 112 in the adjusting direction. Because of the coupling force of the spring 88 that acts upon the control element 60 in the direction of the arrow 8, the stop 62 of the control element 60 rests on the stop location 58 of the intermediate element 40. This control position of the control element 60 may for example be the control position for the control device 74, in which the driving machine 81 operates at an increased idling rpm. The increased idling rpm of the driving machine may for instance be selected such that safe operation of the driving machine 81 is assured even under unfavorable operating conditions, such as when the driving machine is cold and/or if increased output is demanded of an electrical current generator driven by the driving machine 81, and so forth. The increased idling rpm may be preset via the repose-position stop 44. Even if the driving machine 81 is switched off, the transfer element 4, the set-point transducer 6, the intermediate element 40 and the control element 60 are normally located in the respose position described here, or in other words as long as the operating element 2 is not actuated.

The presettable increased idling rpm is not optimal at every moment. It is therefore favorable that in the second operating state the actual rpm of the driving machine 81 can be controlled or regulated. If the operating element 2 is not actuated, the increased idling rpm of the driving machine 81 is normally not necessary, particularly if the driving machine 81 is at a normal operating temperature and no other consumers need to be driven by the driving machine 81. In that case, the idling rpm of the driving machine 81 can be lowered. This is done by electromechanical transfer means. Depending on what signals the electronic control unit 90 receives from the sensors 98, particularly the temperature and rpm sensors, the electronic control unit 90 can trigger the servomotor 82 causing it to move the control element 60 to a corresponding control position. If the idling rpm is too high, then the servomotor 82 can actuate the control element 60 counter to the direction of the arrow 8, so that the stop face 62 of the control element 60 lifts from the stop location 58 of the intermediate element 40. By means of the adjustable end stop 72, the adjustability of the control element 60 in the opposite direction of the arrow 8 can be limited. If in the second operating state the rpm of the driving machine is to be higher than the increased idling rpm, for instance to enable particularly rapid heating of a catalytic converter that may optionally be present, then the control element 60 can be adjusted in the direction of the arrow 8 as well by the electromechanical transfer means. In that case, the intermediate element 40 is likewise carried along in the direction of the arrow 8, and it lifts from the repose-position stop 44. If for any reason, such as if the electronic control unit 90 is defective, the adjusting element 60 is actuated too far in the direction of the arrow 8, then the contact face 50 of the intermediate element 40, after overcoming the shifting distance 112, actuates the contact 32. Upon actuation of the contact 32, the clutch 84 is left without current, and as a result the transfer of force from the servomotor 82 to the control element 60 is interrupted, and the control element 60 is returned by the force of the spring 42 to the control position corresponding to the increased idling rpm. Instead of switching off the clutch 84, the servomotor 82 can also have its polarity reversed. This assures that the driving machine 81 will not reach dangerously high rpm.

In the third operating state, the control position of the set-point transducer 6 is transferred by the electromechanical transfer means to the control position of the control element 60. The travel measuring instruments 34, 36 forward measurement signals in accordance with the control position of the set-point transducer 6 to the electronic control unit 90. The electronic control unit 90 receives further measurement signals from the travel measuring instruments 68, 70 and from the sensors 98. From these measurement signals and with the aid of a program fed into the electronic control unit 90, the electronic control unit 90 forwards control signals to the servomotor 82. The servomotor 82 thus moves the control element 60 to the desired control position. A very favorable feature is that the adjustment of the control element 60 need not necessarily be proportional to the adjustment of the set-point transducer 6; that is, the adjustment may be progressive or degressive, and so forth. For reasons having to do with control technology, luxury, and for safety reasons as well, the stop face 48 of the intermediate element 40 should not touch the stop 26 of the set-point transducer 6 in the third operating state; that is, the spacing 108 should be sufficiently great, especially with nonproportional adjustment. The shifting distance 112 should also be sufficiently great. If, as a result of a defect, the contact face 50 should touch the contact 32, then advantageously either the clutch 84 is switched off or the polarity of the servomotor 82 is reversed.

The fourth operating state, that is, emergency operation with the operating element 2 actuated, arises if a transfer of the control position of the set-point transducer 6 to the control position of the control element 60 by the electromechanical transfer means is not possible, for instance because of some defect in the servomotor 82. If the set-point transducer 6 is actuated by the operating element 2 in the direction of the arrow 8 via the transfer element 4, the set-point transducer 6 initially lifts away from the repose-position stop 20. After overcoming the spacing 108 between the stop 26 of the set-point transducer 6 and the stop face 48 of the intermediate element 40, the intermediate element 40 is likewise carried along in the direction of the arrow 8, counter to the restoring force of the spring 42. Because of the coupling force of the spring 88, the stop face 62 of the adjusting element 60 rests on the stop location 58 of the intermediate element 40. Thus, even in emergency operation, the control element 60 can be adjusted by the operating element 2 via the set-point transducer 6.

In the fifth operating state, the one with cruise control, the driver has specified a particular set-point speed via the transducer 96. Via at least one of the sensors 98, the actual vehicle speed is monitored and reported to the electronic control unit 90. In the fifth operating state, the operating element 2 is normally not actuated. The enlarged position 14 of the transfer element 4 rests on the repose-position stop 15. By means of the electronic control unit 90, the control element 60 is actuated more or less in the direction of the arrow 8 via the servomotor 82, far enough that the actual vehicle speed corresponds as accurately as possible to the set-point speed specified via the transducer 96. The intermediate element 40 is likewise carried along variably far in the direction of the arrow 8 by the control element 60. If the stop 30 shown in dashed lines in the drawing is present in the set-point transducer 6, then after overcoming of the spacing 110 between the stop face 52 of the intermediate element 40 and the stop of the set-point transducer 6, the set-point transducer 6 is likewise carried variably far in the direction of the arrow 8. In the fifth operating state, with cruise control, the clutch 84 is not switched off via the contact 32, and the polarity of the servomotor 82 is not reversed, even if the contact face 50 does touch the contact 32.

Figure 2:
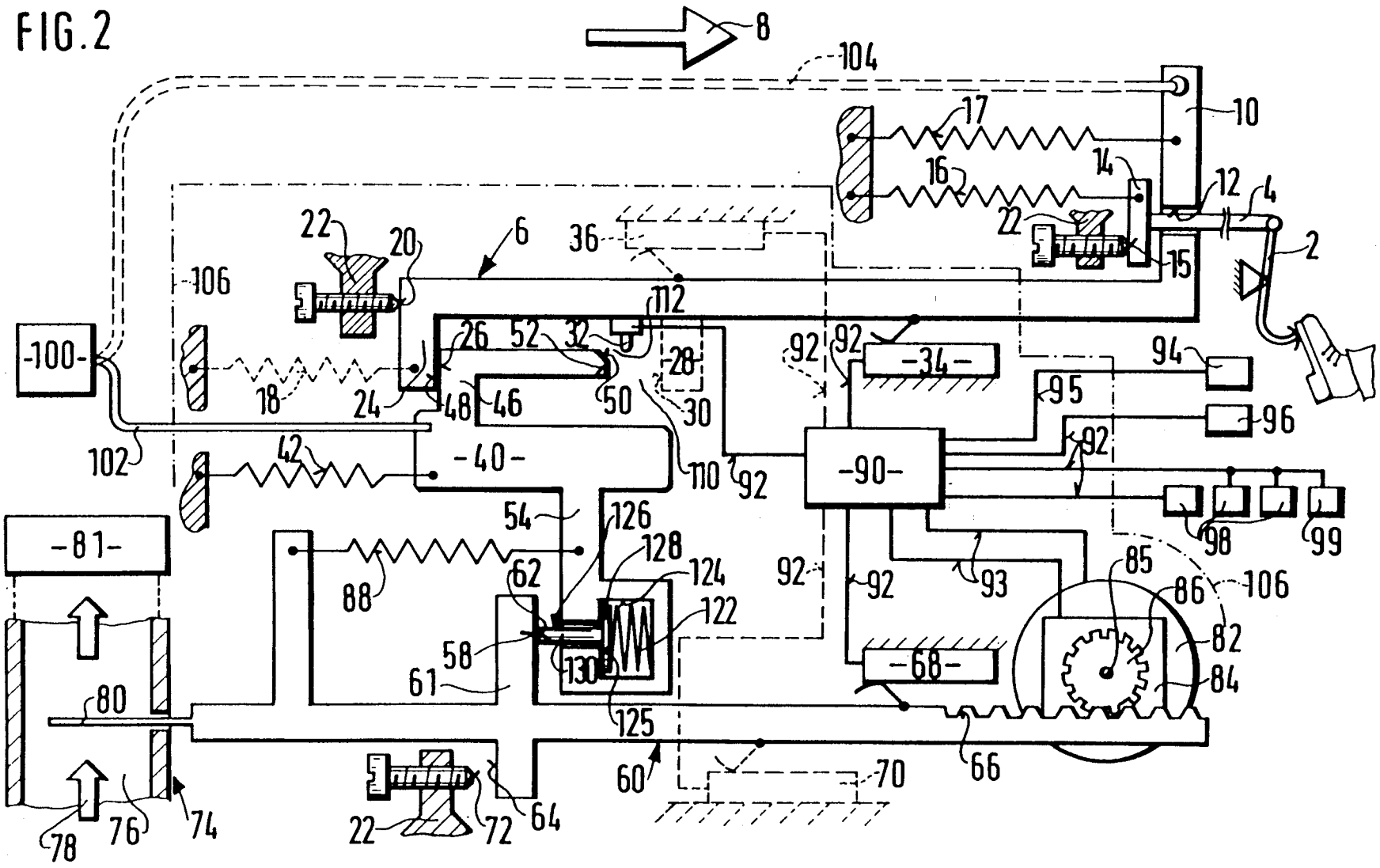
FIG. 2 shows a second exemplary embodiment of a system according to the invention.

FIG. 2 shows the second exemplary embodiment. In all the drawing figures, parts that are identical or function the same are identified by the same reference numerals.

The stop 44 for the position of repose is omitted in the second exemplary embodiment. In this second exemplary embodiment, a further spring 122 is installed on the intermediate element 40 inside a recess 124 with initial stress. The spring 122 acts counter to the direction of the arrow 8 on a stepped pin 126, with the tendency to actuate an enlarged portion 128 of the bolt 126 toward a face end 125 of the recess 124. A smaller diameter portion 130 of the bolt 126 projects variably far outward past the lifter 54 of the intermediate element 40 counter to the direction of the arrow 8. The stop location 58 is located on the end of the pin 126 protruding past the lifter 54. The second exemplary embodiment (FIG. 2) is otherwise identical to the first exemplary embodiment (FIG. 1).

In the first operating state, the enlarged portion 14 of the transfer element 4 rests on the repose-position stop 15, and the set point transducer 6 rests on the repose-position stop 20. The intermediate element 40 is actuated by the restoring force of the spring 42 counter to the direction of the arrow 8 in such a way that the stop face 48 of the intermediate element 40 rests on the stop 26 of the set-point transducer 6. The coupling force of the spring 88 acts on the control element 60 in the direction of the arrow 8, and the force of the spring 122 acts on the control element 60 counter to the direction of the arrow 8. The stop face 62 of the control element 60 rests on the stop location 58 of the pin 126 of the intermediate element 40. Since the force of the spring 122 is greater than the coupling force of the spring 88, the enlarged portion 128 of the pin 126 rests on the face end 125. The resultant control position of the control element 60 is equivalent for instance to the increased idling rpm of the driving machine 81.

In the second operating state, if the output or rpm of the driving machine 81 is to be lowered relative to the increased idling rpm of the first operating state, then the control element 60 can be actuated counter to the direction of the arrow 8 by the electronic control unit 90, via the servomotor 82. The actuation of the control element 60 counter to the direction of the arrow 8 is possible until the stop face 64 of the control element 60 comes to rest on the end stop 72 of the wall 22. If the rpm of the driving machine 81 is greater than the increased idling rpm, then the control element 60 can be actuated in the direction of the arrow 8 counter to the force of the spring 122 by the electronic control unit 90, via the servomotor 82. Since the restoring force of the spring 42 is greater than the force of the spring 122, the enlarged portion 128 of the pin 126 lifts away from the face end 125 of the recess 124. The stop face 48 of the intermediate element 40 normally remains on the stop 26 of the set-point transducer 6 in this process. If because of an electrical defect, for instance, the contact face 50 touches the contact 32 after overcoming the shifting distance 112, then for safety reasons the clutch 84 is released, and the system according to the invention operates in the first operating state, or depending on the predetermined program, the polarity of the servomotor 82 is reversed until such time as the contact face 50 has moved away from the contact 32 again.

In the third operating state, i.e., regular operation, the control position of the control element 60 can be regulated by the electronic control unit 90 with the aid of the servomotor 82 as a function of the program input into the control unit 90 and as a function of the signals originating in the sensors 98 and the measurement signals originating in the travel measuring instruments 34, 36. The stop face 62 of the control element 60, in regular operation, moves variably far away from the stop location 58 of the pin 126 of the intermediate element 40. In the second exemplary embodiment as well, the transfer of the control position of the set-point transducer 6 to the control position of the control element 60 may be non-proportional, depending on the program input into the electronic control unit 90.

In the fourth operating state, emergency operation, the set-point transducer 6 is actuated variably far in the direction of the arrow 8. The stop face 48 of the intermediate element 40 rests on the stop 26 of the set-point transducer 6. The enlarged portion 128 of the pin 126 rests on the face end 125 of the recess 124 of the intermediate element 40. Because of the coupling force of the spring 88, the stop face 62 of the control element 60 touches the stop location 58 of the pin 126 of the intermediate element 40. Thus, even in emergency operation, a control position of the set-point transducer 6 can be transferred to a control position of the control element 60 by the mechanical transfer means.

In the fifth operating state, the electronic control unit 90, with the aid of the servomotor 82, actuates the control element 60 variably far in the direction of the arrow 8, specifically far enough that the actual speed of the vehicle, for instance, is equivalent to the set-point vehicle speed specified with the aid of the transducer 96. The intermediate element 40 is likewise carried along variably far in the direction of the arrow 8 in the fifth operating state. If the slaving element 28 shown in dashed lines is present on the set-point transducer 6, then after the spacing 110 is overcome, the set-point transducer 6 is likewise carried along by the control element 60 via the intermediate element 40.

In both exemplary embodiments, influence can be exerted upon the actuatable element 100 with the aid of the system according to the invention. There are various possibilities for this. Either the actuatable element 100 is connected to the intermediate element 40 via the Bowden cable 102, or the actuatable element 100 is connected to the lifter 10 and hence to the set-point transducer 6 via the Bowden cable 104. Because intrinsically one of the two Bowden cables 102, 104 suffices, the Bowden cable 104 is an alternative and is therefore shown in dashed lines. If the actuatable element 100 is connected to the set-point transducer 6 via the Bowden cable 104 and if action is to be exerted on the actuatable element 100 in the fifth operating state as well, then the slaving element 28 and the stop 30 are required on the set-point transducer 6. Otherwise, the slaving element 28 shown in dashed lines can be omitted. Indirect action by the element 100 on the control element 60 via the Bowden cable 102 or 104 is also possible as needed.

In the second and third operating state, the contact 32 serves to increase safety, to prevent the rpm of the driving machine 81 from rising to an excessively high value in any event. If, in fact, the control element 60, because of any defect, is actuated overly far in the direction of the arrow 8 via the servomotor 82, then the contact face 50 of the intermediate element 40, after overcoming the shifting distance 112, comes to touch the contact 32. This signals the electronic control unit 90 that there is a defect. As a result, either the transfer of force from the servomotor 82 to the control element 60 is interrupted by releasing the clutch 84, or the polarity of the servomotor 82 is reversed until the contact face 50 rises from the contact 32. The shifting may for instance be embodied such that the clutch 84 is open when without current, and the supply of current to the clutch 84 is interrupted via the contact 32. In the fifth operating state, the contact 32 is not in service.

The second travel measuring instrument 36 for detecting the control position of the set-point transducer 6 and the second travel measuring instrument 70 for detecting the control position of the control element 60 serve to increase safety. As soon as the electronic control unit 90 ascertains that the measurement signals that it receives from the travel measuring instruments 34, 36 or 68, 70 are overly far apart, the clutch 84 is released. In the case where the contact 32 is present, the additional travel measuring instruments 36, 70 are intrinsically unnecessary, and so they have been shown in the drawing in dashed lines. If the additional travel measuring instruments 36, 70 are present, then the contact 32 may optionally be omitted without any notable loss of safety.

Figure 3:
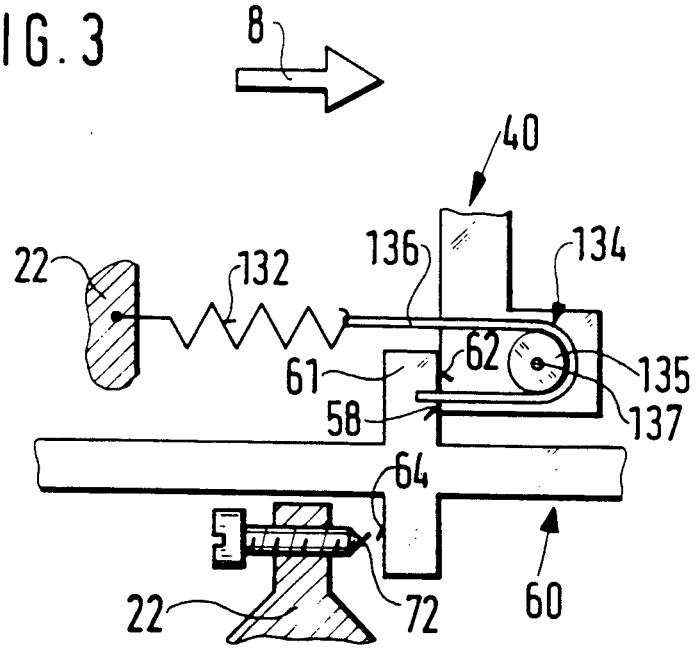
FIGS. 3-5 show possible variants of the two exemplary embodiments.
Figure 4:
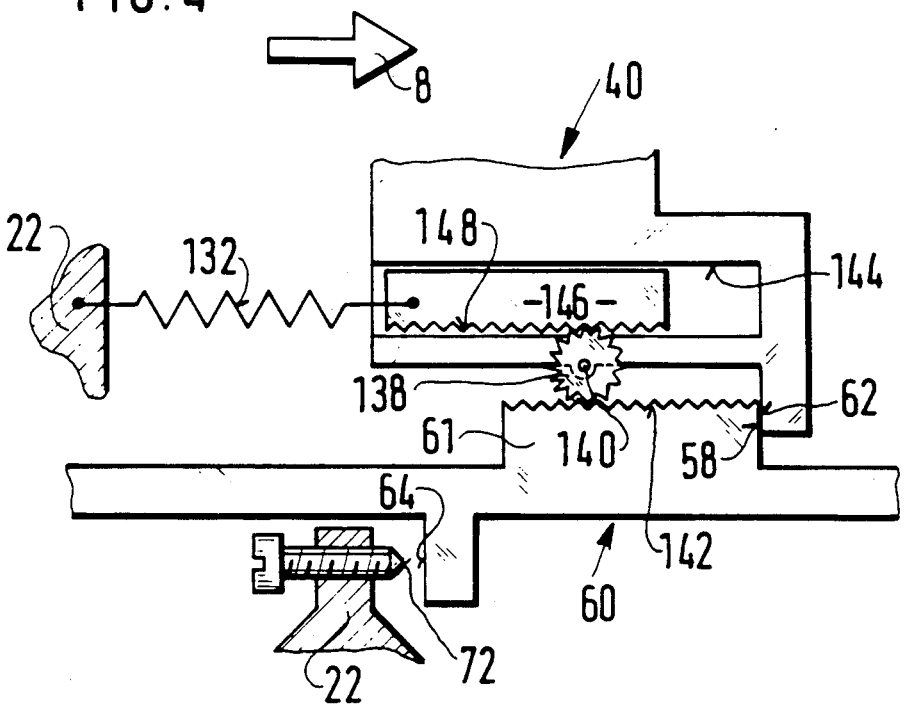

In both exemplary embodiments of FIGS. 1 and 2 of the system according to the invention, the region having the intermediate element 40, the control element 60 and the springs 42, 88 can also be embodied somewhat differently. FIGS. 3 and 4 are details of two variants. In FIGS. 3 and 4, this region is embodied such that instead of the two springs 42, 88, only one spring 132 is required.

In the variant of FIG. 3, a deflecting means 134 is disposed on the intermediate element 40. One end of the spring 132 is coupled to the wall 22; another end of the spring 132 is connected to one end of a flexible structural component 136, such as a belt. The flexible component 136 wraps partway around the deflecting means 134; it is deflected by 180° there. Another end of the flexible component 136 is connected to the step 61 of the control element 60. The deflecting means 134 is advantageously a roller 135 rotatably supported with low friction on a bolt 137, and the bolt 137 is firmly connected to the intermediate element 40.

Via the flexible component 136 and the deflecting means 134, the spring 132 can act upon the control element 60 in the direction of the arrow 8 and upon the intermediate element 40 counter to the direction of the arrow 8. Thus, the spring 132 serves both to generate the coupling force between the intermediate element 40 and the control element 60 and to generate the restoring force acting upon the intermediate element 40.

In the variant of FIG. 4, a gear wheel 138 is rotatably supported in a bearing 140 on the intermediate element 40. A gear tooth profile 142 connected to the gear wheel 138 is located on the step 61 of the control element 60. A profile rod 146, displaceably supported parallel to the direction of the arrow 8 and having a gear tooth profile 148, is supported in a guide 144 of the intermediate element 40. The gear tooth profile 148 meshes with the gear wheel 138. One end of the spring 132 is coupled to the wall 22 and another end of the spring 132 is coupled to the profile rod 146. The spring 132 acts on the profile rod 146 counter to the direction of the arrow 8. The spring 132 acts via the profile rod 146, the gear wheel 138 and the bearing 140 upon the intermediate element 40 counter to the direction of the arrow 8. However, the spring 132 also acts upon the control element 60 in the direction of the arrow 8 via the profile rod 146, the gear wheel 138 and the gear tooth profile 142 on the step 61 of the control element 60. In the variant of FIG. 4 as well, the spring 132 serves to generate the coupling force between the intermediate element 40 and the control element 60 and also serves to generate the restoring force acting upon the intermediate element 40.

The two variants of FIGS. 3 and 4 can be used in both exemplary embodiments of FIGS. 1 and 2. Even if the second exemplary embodiment is in accordance with one of the variants of FIG. 3 or 4, the recess 124 with the spring 122 and the pin 126 with the stop location 58 can be provided on the intermediate element 40.

It is especially practical to secure the system according to the invention as much as possible directly on the control device 74, so that the control device 74 and the largest possible portion of the system according to the invention form a unit. The system according to the invention may be protected by the housing 106 shown in dot-dashed lines in the drawing. A minimum number of recesses is required in the housing 106. The only elements that need to be passed through the housing 106 are the energy supply cable 95, and the cables 92 to the transducer 96, sensors 98 and further control unit 99.

Optionally, the cables 92, 95, or some of the cables 92, 95, can be combined in one line. The connection of the cables 92, 95 may for instance be effected by a so-called serial interface or by a plurality of these interfaces. The interfaces may for instance be embodied by so-called CAN components.

Furthermore, the set-point transducer 6 must be passed through the housing 106. If the actuatable element 100 is connected via the Bowden cable 104 to the lifter 10 of the set-point transducer 6 that protrudes out of the housing 106, then in order to trigger the actuatable element 100 no additional recess in the housing 106 is needed, which is advantageous. The situation is different if the actuatable element 100 is connected to the intermediate element 40 via the Bowden cable 102, because the Bowden cable 102 must be passed through a recess in the housing 106.

Figure 5:
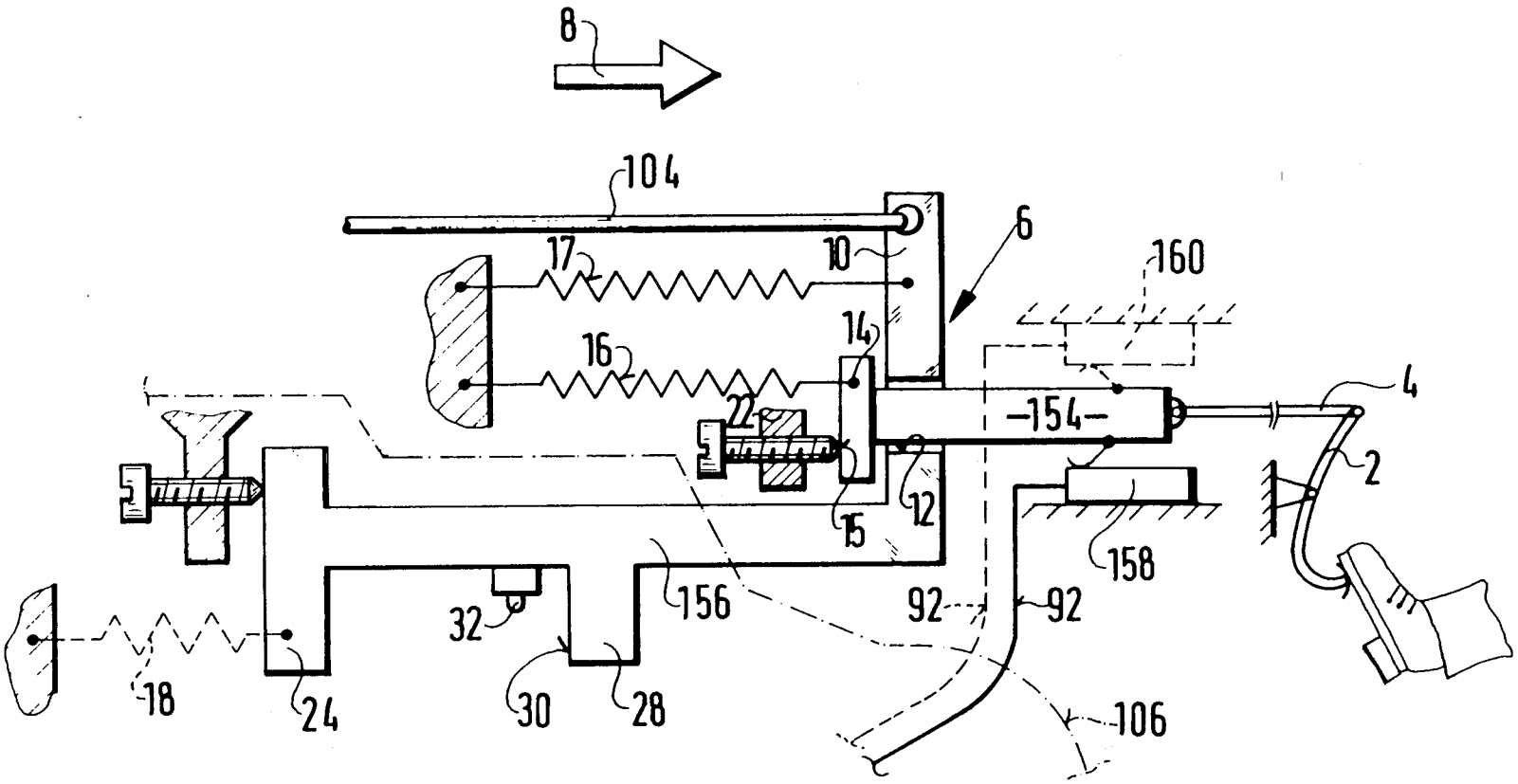

In the third operating state, if the set-point transducer 6 is actuated relatively far in the direction of the arrow 8 by the operating element 2 and if the operating element 2 is released beginning at this position, then the restoring spring 16 pulls the transfer element 4 toward the repose-position stop 15. The restoring springs 17, 18 actuate the set-point transducer 6 counter to the direction of the arrow 8, initially until the stop 30 of the slaving element 28 of the set-point transducer 6 comes to rest on the stop face 52 of the intermediate element 40. The set-point transducer 6 can be further restored counter to the direction of the arrow 8 only in common with the intermediate element 40. In the case where the stop 30 is provided, this can lead to a somewhat reduced return speed of the set-point transducer 6, and the travel measuring instruments 34, 36 can detect a return of the operating element 2 only after some delay. To avoid that, the set-point transducer 6 may be embodied in two parts as shown in FIG. 5. In this variant, the set-point transducer 6 comprises a first part 154 and a second part 156. The transfer element 4 is connected to the first part 154 of the set-point transducer 6. The lifters 10 and 24, the slaving element 28 with the stop 30, the contact 32 and the through opening 12 are located on the second part 156 of the set-point transducer 6. The first part 154 of the set-point transducer 6 is passed through the through opening 12 of the second part 156 of the set-point transducer 6, and the enlarged portion 14 is disposed on the side of the first part 154 of the set-point transducer 6 remote from the transfer element 4. The control position of the first part 154 of the set-point transducer 6 can be detected via a travel measuring instrument 158, and as needed also via a second travel measuring instrument 160. The measurement signals of the travel measuring instruments 158, 160 are forwarded to the electronic control unit 90 via the electric cables 92.

Both the first exemplary embodiment of FIG. 1 and the second exemplary embodiment of FIG. 2 can be modified in accordance with the variant, a detail of which is shown in FIG. 5. As previous tests show, even with the stop 30 present on the set-point transducer 6, it is not always necessary to embody the set-point transducer 6 in two parts as in FIG. 5. In most applications, the spacing 110 between the stop 30 and the stop face 52 can be selected to be sufficiently great so that even if the set-point transducer 6 is in one part, a sufficient return speed is produced. With a view to a simple, compact structure it may be more favorable to embody the set-point transducer 6 in one piece.

If the system according to the invention is used in a motor vehicle, for instance, then it can occasionally happen that the driving machine 81 exerts a greater driving torque on the drive wheels than can be transferred by the drive wheels to the road or other surface on which the vehicle is traveling. In this case, so-called drive slip or loss of traction occurs at the drive wheels. However, it can also occasionally happen, for instance if the operating element 2 is released when driving on a slippery surface, that a braking of the driving machine 81 transferred to the drive wheels is so high that it can no longer be transferred by the drive wheels to the road or other surface. In that case, so-called braking slip exists between the drive wheels and the road or other surface. Drive slip and braking slip can be detected by one or more of the sensors 98 and sent to the control unit 90. In the case of drive slip, the electronic control system 90 moves the control element 60, via the servomotor 82, more in the direction of lower power of the driving machine 81, which is known as ASR, and in the event of braking slip, the electronic control unit 90 via the servomotor 82 moves the control element 60 more in the direction of greater power of the driving machine 81, or MSR operation. Both situations can arise so quickly that persons in the vehicle notice nothing, or substantially nothing, of the events. A particularly favorable feature is that in the first exemplary embodiment (FIG. 1) in ASR, the intermediate element 40 is jointly adjusted by no more than the spacing 108. If the actuatable element 100 is actuated via the Bowden cable 104, then ASR has no effect on the actuatable element 100. If it is actuated via the Bowden cable 102, then the influence on the actuatable element 100 is equivalent to no more than the spacing 108 and should usually be negligibly slight. In the second exemplary embodiment, ASR advantageously has no effect on the actuatable element 100.

The system according to the invention has been explained with reference to two exemplary embodiments, in which the set-point transducer 6, intermediate element 40 and control element 60 are capable of executing a rectilinear motion parallel to the arrow 8. It is equally possible, and in many applications more favorable, for the set-point transducer 6, intermediate element 40 and control element 60 to be rotatably supported on pivot shafts; it is particularly practical if all the pivot shafts are aligned in a single line. In that case the set-point transducer 6, intermediate element 40 and control element 60 do not execute any reciprocating motion parallel to the arrow 8 but instead execute more or less pronounced swiveling motions about the pivot shaft. A control motion in the direction of the arrow 8 then represents a pivoting motion in one rotational direction and a control motion counter to the arrow 8 means a pivoting motion in the opposite direction. All the components may be embodied as more or less round or curved.

The throttle valve 80 of the control device 74 is usually pivotably supported. It is practical for the control element 60 to be likewise pivotable. It is particularly favorable to dispose the throttle valve 80, the control element 60, the drive wheel 86, the intermediate element 40 and the set-point transducer 6 on a mutually aligned pivot shaft. If the outgoing shaft 85 of the clutch 84 is likewise in alignment with the control element 60, then in that case both the profile 66 on the control element 60 and the drive wheel 86 can be omitted. A rotational motion of the outgoing shaft 85 can then be transferred directly into a rotational motion of the control element 60. A particularly elegant solution is to dispose the pivot shaft for the throttle valve 80 such that a shaft of the throttle valve 80 protrudes out of the intake tube portion 76 on the sides. On one side of the intake tube portion 76, the control element 60 having the stop face 64 and the step 61 on which the stop face 62 is located is disposed in disk-like fashion and connected to the shaft of the throttle valve 80. Also practically located on this side are the intermediate elements 40, the set-point transducer 6, and the springs 42, 88 or 132. Disposed on the other side of the intake tube portion 76 is the servomotor 82 and the clutch 84. The outgoing shaft 85 of the clutch 84 can be connected directly to the control element 60 without any drive wheel.

In the drawing, the springs 42, 88, 132 and the restoring springs 16, 17, 18 are by way of example tension springs, while the spring 122 is a compression spring. This is merely by way of example. The springs may have any other embodiment instead. If the set-point transducer 6, the intermediate element 40 and the control element 60 are rotatably supported, then it is particularly practical to embody the springs 16, 17, 18, 42, 88, 122 and 132, or at least some of them, in the form of flexible springs, in particular in the form of spiral springs.

In the second, third and fifth operating state, the control element 60 is adjusted via the electromechanical transfer means. If this adjustment option should fail, then the control element 60 is mechanically coupled to the set-point transducer 6; that is, a transition to the first or fourth operating state takes place. In the transition, the output of the driving machine varies slightly, but this is often hardly noticeable.

In the first exemplary embodiment of FIG. 1, the output is lowered somewhat in the transition in accordance with the spacing 108; in the second exemplary embodiment of FIG. 2 it is increased somewhat. If the machine is a vehicle, then for safety reasons lowering at the transition and hence the first exemplary embodiment is more likely to be favorable than the second exemplary embodiment. If the machine is a stationary-mounted engine, then an increase in the output at the transition and hence the second exemplary embodiment would be more favorable than the first exemplary embodiment.

The intermediate element 40 of the second exemplary embodiment of FIG. 2 may also be embodied without the spring 122 or pin 126. In that case the stop location 58 is located directly on the intermediate element 40, as is shown in the first exemplary embodiment of FIG. 1. If the stop location 58 is located directly on the intermediate element 40, then if the rpm of the driving machine 81 is to be raised above the increased idling rpm in the second operating state, the intermediate element 40 is then moved out of contact with the set-point transducer 6 counter to the restoring force of the springs 42, 132. The shifting distance 112 should be selected to be sufficiently great. For control technology reasons, the spring 122 and the bolt 126 still offer advantages, however.

Given a suitable design of the electronic control unit 90, a regular automatic check of the springs 42, 88, 122, 132 is possible, for instance immediately after each starting of the driving machine 81. In the check, the electronic control unit 90, via the servomotor 82, actuates the control element 60 somewhat in some practical adjustment direction. After that the electronic control unit 90 can ascertain whether the springs 42, 88, 122, 132 do return the control element 60 to the original control position. The option of checking the springs is particularly advantageous, because otherwise a defective spring would be discovered only after a failure of the electromechanical transfer means. This could possibly lead to a failure of the entire apparatus.

In both exemplary embodiments of FIGS. 1 and 2, the transfer element 4 is connected to the set-point transducer 6 in such a way that upon actuation of the set-point transducer 6 in the direction of the arrow 8, the transfer element 4 is not carried along. However, it is also possible to connect the transfer element 4 to the set-point transducer 6 in such a way that upon actuation of the set-point transducer 6 by the servomotor 82 in the direction of the arrow 8, the transfer element 4 is at least partly carried along, or slaved; that is, the transfer element 4 may for instance be firmly connected to the set-point transducer 6. Particularly in this case, a single one of the restoring springs 16, 17, 18 is sufficient.

If stronger actuating forces for actuating the operating element 2 are allowable in emergency operation, then the clutch 84 may optionally be omitted. In that case, the servomotor 82 must be jointly actuated in emergency operation.

A particularly great advantage of the system according to the invention is that the forces of the springs 16, 17, 18, 42, 88 and 132 can be selected independently of one another; advantageously, there is no mutual dependency. In dimensioning one of the springs, no account need be taken of any other spring. Only in the second exemplary embodiment (FIG. 2) does the spring 122 need to be stronger than the spring 88, but weaker than the sum of the springs 42 plus 88. Since as already mentioned the second exemplary embodiment can also be made without the spring 122, there is no mutual dependency between the springs in this variant.

The foregoing relates to a preferred exemplary embodiment of the invention, it being understood that other variants and embodiments thereof are possible within the spirit and scope of the invention, the latter being defined by the appended claims.

What is claimed and desired to be secured by Letters Patent of the United States is:

1. A system including a set-point transducer and a control element (60) in which a control position of a said set-point transducer is transferred to a control position of said control element to determine an output of a driving machine by electromechanical transmission means, as well as by a mechanical transmission means which couples said control element (60) to said set-point transducer (6), said control element is decoupled from said set-point transducer whenever a control position of said control element is equivalent to a control position of the set-point transducer, said mechanical transmission means includes an intermediate element (40) between said set-point transducer (6) and said control element (60) as well as a spring (88, 132) which generates a coupling force that forces a stop face (62) of the said control element (60) toward a stop location (58) of said intermediate element (40).

2. A system as defined by claim 1, in which said intermediate element (40) is restorable to a position of repose by means of a restoring force, of a spring (42, 132) acting upon the intermediate element (40).

3. A system as defined by claim 1, which includes a first repose-position stop (44) and said intermediate element (40) is restorable toward said first repose-position stop (44).

4. A system as defined by claim 2, which includes a first repose-position stop (44) and said intermediate element (40) is restorable toward said first repose-position stop (44).

5. A system as defined by claim 1, which includes a second repose position stop (20) and said set-point transducer (6) is restorable to a position of repose toward said second repose position stop (20) by means of at least one restoring spring (17, 18) acting upon said set-point transducer (6).

6. A system as defined by claim 2, which includes a second repose position stop (20) and said set-point transducer (6) is restorable to a position of repose toward said second repose position stop (20) by means of at least one restoring spring (17, 18) acting upon said set-point transducer (6).

7. A system as defined by claim 3, which includes a second repose position stop (20) and said set-point transducer (6) is restorable to a position of repose toward said second repose position stop (20) by means of at least one restoring spring (17, 18) acting upon said set-point transducer (6).

8. A system as defined by claim 4, which includes a second repose position stop (20) and said set-point transducer (6) is restorable to a position of repose toward said second repose position stop (20) by means of at least one restoring spring (17, 18) acting upon said set-point transducer (6).

9. A system as defined by claim 1, in which said electromechanical transmission means (34, 36, 68, 70, 82, 84, 86, 90, 158, 160) include a servomotor (82), and said servomotor activates said control element (60) in an adjustment direction.

10. A system as defined by claim 9, which includes a shiftable clutch (84) between said servomotor (82) and said control element (60).

11. A system as defined by claim 1, in which said electromechanical transmission means (34, 36, 68, 70, 82, 84, 86, 90, 158, 160) include at least two travel measuring instruments (34, 36, 68, 70, 158, 160), wherein a control position of said set-point transducer (6) can be ascertained with at least one travel measuring instrument (34, 36, 158, 160), and a control position of said control element (60) can be ascertained with at least one travel measuring instrument (68, 70).

12. A system including a set-point transducer which includes a stop (26) thereon, and a control element in which a control position of said set-point transducer is transferred to a control position of said control element to determine an output of a driving machine by electromechanical transfer means, as well as by mechanical transfer means, said control element is decoupled from said set-point transducer whenever a control position of said control element is equivalent to a control position of the set-point transducer, said mechanical transfer means includes an intermediate element (40) as well as a spring (88, 132) which generates a coupling force that forces a stop face (62) of the said control element (60) toward a stop location (58) of said intermediate element (40), and said intermediate element (40) is disposed such that it is movable relative to said set-point transducer (6) in an adjustment direction until said stop (26) of said set-point transducer (6) comes to rest on a stop face (48) on said intermediate element (40).

13. A system including a set-point transducer and a control element in which a control position of said set-point transducer is transferred to a control position of said control element to determine an output of a driving machine by electromechanical transfer means, as well as by mechanical transfer means, said control element is decoupled from said set-point transducer whenever a control position of said control element is equivalent to a control position of the set-point transducer, said mechanical transfer means includes an intermediate element (40) as well as a spring (88, 132) which generates a coupling force that forces a stop face (62) of the said control element (60) toward a stop location (58) of said intermediate element (40), and said intermediate element (40) is disposed such that it is movable relative to said set-point transducer (6) in an adjustment direction until a stop face (52) of said intermediate element (40) comes to rest on a stop (30) on said set-point transducer.

14. A system including a set-point transducer and a control element in which a control position of said set-point transducer is transferred to a control position of said control element to determine an output of a driving machine by electromechanical transfer means, as well as by mechanical transfer means, said control element is decoupled from said set-point transducer whenever a control position of said control element is equivalent to a control position of the set-point transducer, said mechanical transfer means includes an intermediate element (40) as well as a spring (88, 132) which generates a coupling force that forces a stop face (62) of the said control element (60) toward a stop location (58) of said intermediate element (40), and an electrical contact (32) is disposed on the mechanical transfer means (6, 40, 60, 88), said contact (32) produces an electrical signal after a shifting distance (112) present between said intermediate element (40) and the contact (32) is overcome.

15. A system including a set-point transducer and a control element in which a control position of said set-point transducer is transferred to a control position of said control element to determine an output of a driving machine by electromechanical transfer means, as well as by mechanical transfer means, said control element is decoupled from said set-point transducer whenever a control position of said control element is equivalent to a control position of the set-point transducer, said mechanical transfer means includes an intermediate element (40) as well as a spring (88, 132) which generates a coupling force that forces a stop face (62) of the said control element (60) toward a stop location (58) of said intermediate element (40), and an actuating means (104) which transfers a control position of the set-point transducer (6) to an actuatable element (100).

16. A system including a set-point transducer and a control element in which a control position of said set-point transducer is transferred to a control position of said control element to determine an output of a driving machine by electromechanical transfer means, as well as by mechanical transfer means, said control element is decoupled from said set-point transducer whenever a control position of said control element is equivalent to a control position of the set-point transducer, said mechanical transfer means includes an intermediate element (40) as well as a spring (88, 132) which generates a coupling force that forces a stop face (62) of the said control element (60) toward a stop location (58) of said intermediate element (40), and an activating means (102) between the intermediate element (40) and an actuatable element (100), by means of which a control position of said intermediate element (40) is transferrable to said actuatable element (100).

17. A system including a set-point transducer and a control element in which a control position of said set-point transducer is transferred to a control position of said control element to determine an output of a driving machine by electromechanical transfer means, as well as by mechanical transfer means, said control element is decoupled from said set-point transducer whenever a control position of said control element is equivalent to a control position of the set-point transducer, said mechanical transfer means includes an intermediate element (40) as well as a spring (88, 132) which generates a coupling force that forces a stop face (62) of the said control element (60) toward a stop location (58) of said intermediate element (40), said electromechanical transfer means (34, 36, 68, 70, 82, 84, 86, 90, 158, 160) include a servomotor (82), and said servomotor activates said control element (60) in an adjustment direction, and said stop face (62) of said control element (60) can be moved away from said stop location (58) of said intermediate element (40) by said servomotor (81) counter to a coupling force (82, 132).

18. A system including a set-point transducer and a control element in which a control position of said set-point transducer is transferred to a control position of said control element to determine an output of a driving machine by electromechanical transfer means, as well as by mechanical transfer means, said control element is decoupled from said set-point transducer whenever a control position of said control element is equivalent to a control position of the set-point transducer, said mechanical transfer means includes an intermediate element (40) as well as a spring (88, 132) which generates a coupling force that forces a stop face (62) of the said control element (60) toward a stop location (58) of said intermediate element (40), said electromechanical transfer means (34, 36, 68, 70, 82, 84, 86, 90, 158, 160) include a servomotor (82), and said servomotor activates said control element (60) in an adjustment direction, a shiftable clutch (84) between said servomotor (82) and said control element (60), and said stop face (62) of said control element (60) can be moved away from said stop location (58) of said intermediate element (40) by said servomotor (82) counter to a coupling spring force (88, 132).

19. A system including a set-point transducer and a control element in which a control position of said set-point transducer is transferred to a control position of said control element to determine an output of a driving machine by electromechanical transfer means, as well as by mechanical transfer means, said control element is decoupled from said set-point transducer whenever a control position of said control element is equivalent to a control position of the set-point transducer, said mechanical transfer means includes an intermediate element (40) as well as a spring (88, 132) which generates a coupling force that forces a stop face (62) of the said control element (60) toward a stop location (58) of said intermediate element (40), said stop face (62) of said control element (60) can be moved away from said stop location (58) of said intermediate element (40) by a servomotor (82) counter to a coupling spring force (88, 132), said electromechanical transfer means (34, 36, 68, 70, 82, 84, 86, 90, 158, 160) include at least two travel measuring instruments (34, 36, 68, 70, 158, 160), wherein a control position of said set-point transducer (6) can be ascertained with at least one travel measuring instrument (34, 36, 158, 160), and a control position of said control element (60) can be ascertained with at least one travel measuring instrument (68, 70).

20. A system as defined by claim 12, in which said intermediate element (40), after overcoming a spacing (108, 110), is coupled in a form-fitting manner to said set-point transducer (6) via a stop (26, 30) and a stop face (48, 52).

21. A system as defined by claim 13, in which said intermediate element (40), after overcoming a spacing (108, 110), is coupled in a form-fitting manner to said set-point transducer (6) via a stop (26, 30) and a stop face (48, 52).

22. A system as defined by claim 19, in which said control element (60) is adjustable toward an end stop (72).

23. A system as defined by claim 2, which includes a spring (132) which produces a coupling force and a restoring force by means of a force deflection means (134, 138).

24. A system as defined by claim 11, in which said set-point transducer (6) comprises a first part (154) and a second part (156) and a control position of said first part (154) of the set-point transducer (6) is detected by at least one travel measuring instrument (158, 160).

25. A system as defined by claim 19, in which said set-point transducer (6) comprises a first part (154) and a second part (156) and a control position of said first part (154) of the set-point transducer (6) is detected by at least one travel measuring instrument (158, 160).

26. A system as defined by claim 18, in which said set-point transducer (6) comprises a first part (154) and a second part (156) and a control position of said first part (154) of the set-point transducer (6) is detected by at least one travel measuring instrument (158, 160).

* * * * *